United States Patent [19]

Bishop

[11] 4,077,005

[45] Feb. 28, 1978

[54] SECURE POSITION IDENTITY AND TIME REPORTING SYSTEM

[75] Inventor: Walton B. Bishop, Oxon Hill, Md.

[73] Assignee: The United States of America as represented by the Secretary of the Navy, Washington, D.C.

[21] Appl. No.: 154,617

[22] Filed: Jun. 18, 1971

[51] Int. Cl.[2] ..... H04K 1/00

[52] U.S. Cl. ..... 325/32; 325/4; 325/6; 343/100 ST

[58] Field of Search ..... 343/7.5, 100 ST; 325/32, 4, 6, 115

[56] References Cited

U.S. PATENT DOCUMENTS

| | | | |
|---|---|---|---|
| 3,126,545 | 3/1964 | Smith, Jr. | 343/100 ST |
| 3,177,472 | 4/1965 | Githens | 343/100 ST |
| 3,378,837 | 4/1968 | Graves | 343/100 ST |
| 3,551,813 | 12/1970 | Kaneko | 325/4 |

*Primary Examiner*—Howard A. Birmiel
*Attorney, Agent, or Firm*—R. S. Sciascia; Philip Schneider; Sol Sheinbein

[57] ABSTRACT

A system for identifying ships and aircraft, both in position and time, utilizing shipboard cryptographic equipment and satellites is described.

5 Claims, 1 Drawing Figure

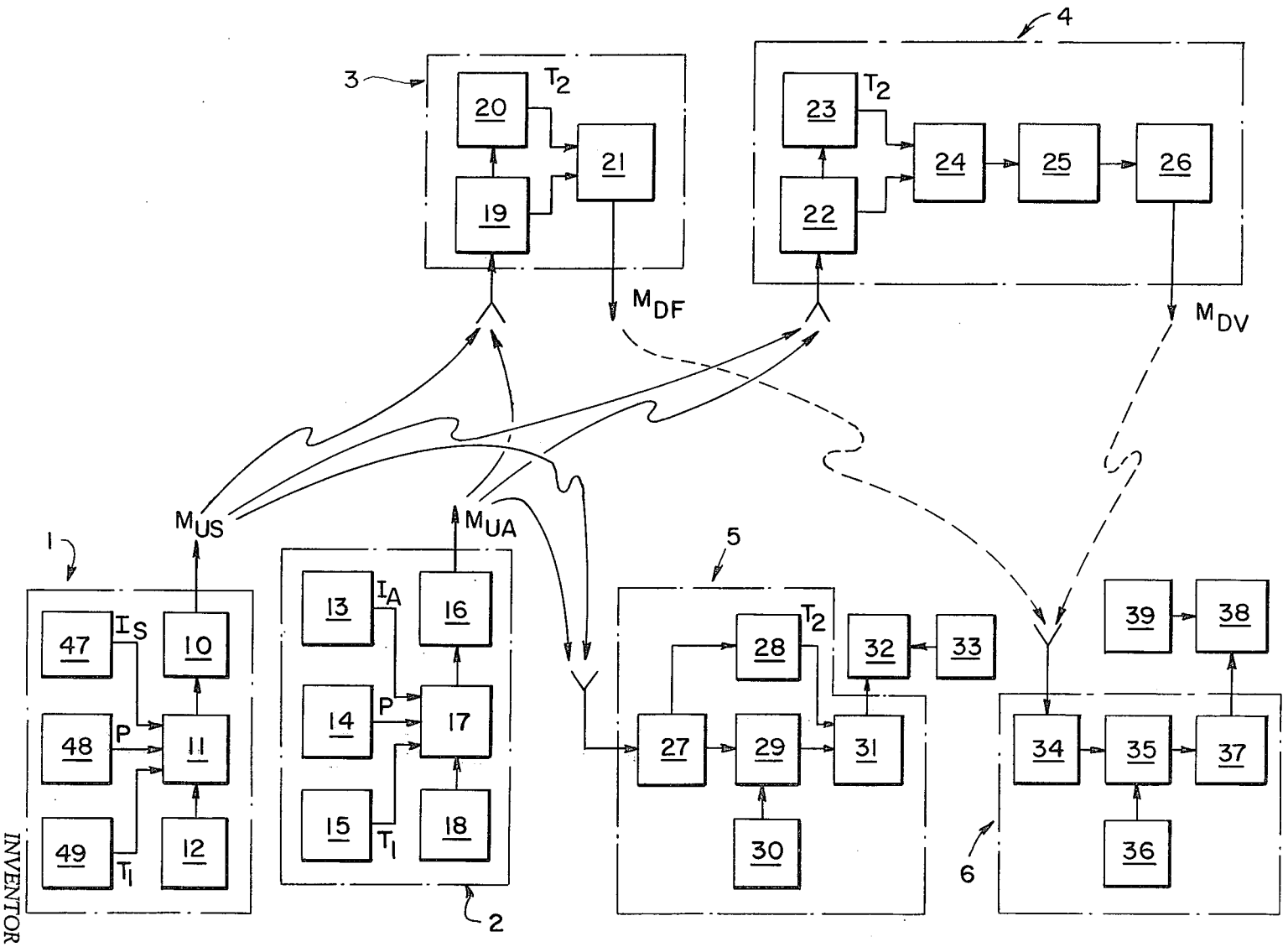
INVENTOR
WALTON B. BISHOP
BY Sol Sheinbein
Arthur T. Fleming ATTORNEYS

SECURE POSITION IDENTITY AND TIME REPORTING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

From 1940 to 1970, the prime requirement for electronic identification systems was to separate friends from foes so that foes could be attacked without endangering friends. Since most weapons had little or no capability beyond line-of-sight range, most identification systems were designed to operate only within this range, and all were designed to make identifications quickly so that attacks could be timely. Identification information has been relayed from one unit to another in some cases to provide advance warning over greater than line-of-sight ranges. The use of satellites to perform communications and navigation functions, and their potential use for weaponry now expands the identification problem. Both greater ranges and new functions beyond those ordinarily considered are important.

The military has been concerned with the identification of remote vehicles (primarily aircraft and ships) for over 30 years. Primary emphasis has been on identification by interrogation-reply systems, and usually these have been associated with radars so that the targets detected by radar could be identified. The possibility of using a time-division data link to identify aircraft was investigated by the Air Force in the early 1950's, but was finally abandoned to permit concentration on interrogation-reply type systems. Previous, present and planned military identification systems have made use of interrogation reply techniques, or have required precise time synchronization or have been vulnerable to enemy attempts to appear as friends, i.e., to enemy "spoofing."

The Mark XII Identification System and its predecessors have been concerned only with the identification of vehicles that are within direct, or "line-of-sight," range. The rapidity with which such identifications usually have to be made makes this category of identification requirements the most difficult to satisfy with a one-way reporting-type system because of the large number of reports and the speed with which data must be processed.

It became clear in the late 1950's that the sophistication required to make the Mark XII system truly effective made it essentially a very special type of digital communications system. Somewhat similar digital communications systems had also been developed by that time for navigation purposes, and a large variety of such systems had been developed for communications functions. In recognition of the similarities, and in some cases duplication, of functions to be performed, it was suggested that the cooperative functions in communications, navigation, and identification systems should be combined.

SUMMARY OF THE INVENTION

The present invention overcomes the disadvantages of prior art identification systems by having each ship report its position P, its identification code word I, and the time of day $T_1$ via a cryptosecure channel to a satellite each time the satellite comes within range. The satellite stores this information along with the time of day $T_2$ when it was received until an orbital position within range of a surface based central processing unit has been reached. The enciphered message $C(I + P + T_1) + T_2$ is then transmitted to the central processor, and a data analyzer deciphers the message to obtain I, P, $T_1$ and $T_2$. If the difference between $T_1$ and $T_2$ is within predetermined limits, then the position P of ship I at time $T_1$ may be safely displayed as valid information.

OBJECTS OF THE INVENTION

It is therefore an object of the present invention to provide a new way of identifying ships and aircraft remotely for military purposes.

Another object of the present invention is to provide an identification system for identifying ships and aircraft over oceans via satellites with cryptographic security without requiring cryptographic material in the satellite.

Yet another object of the present invention is to provide an identification system incapable of being utilized by the enemy.

A still further object of the present invention is to provide an identification system that makes use of equipment already in use aboard the ships and aircraft to be identified.

Yet another object of the present invention is to provide a cryptosecure, spoof-proof, one way transmission identification system that does not require high precision time synchronization.

A still further object of the present invention is to provide an identification system that can be used either with direct r-f transmissions or with r-f transmissions relayed via satellite of either fixed or variable position, and a means of correlating targets identified with those detected by other sensors.

Further objects and advantages of the present invention will be readily apparent to those skilled in the art from a further reading of the present specification and claims, particularly when viewed in the light of the drawing, in which:

The FIGURE is a block diagram representation of the Secure Position and Time Reporting System of the present invention.

DESCRIPTION OF THE PREFERRED EMBODIMENT

The Secure Position Identity and Time (SPIT) Reporting System can best be described by referring to the FIGURE.

Block 1 represents shipboard equipment; block 2, airborne equipment; block 3, the equipment in a fixed-position (geostationary) satellite; block 4, the equipment in a variable-position (low-altitude) satellite; block 5, the equipment in a ground or surface-based identification terminal that identifies aircraft or ships by direct r-f links; and block 6, the equipment in a ground or surface-based identification terminal that makes use of a satellite (either fixed or variable position) to identify ships or aircraft.

The individual-identification code word $I_S$ assigned to a ship is stored in the storage register 47. The position P of the ship is determined to an accuracy of $\pm$ 2 nm (although greater accuracy might also be used) by the ship's navigation equipment 48, and the time-of-day $T_1$ at which each report is made by the ship is determined by the clock 49. Systems Analysis studies indicate that a 13-bit binary message would be adequate for $I_S$, a 16-bit message adequate for P and a 17-bit message adequate for $T_1$. This assumes that time accuracy of ± 1 second over a 24-hour period, the time assumed for use of each cryptographic key setting, is to be used. Many applications might be satisfied with less severe time accuracies.

The three binary messages $I_S$, P, and $T_1$ are combined to form a 46-bit message which is designated as $I_S + P + T_1$. This 46-bit message is enciphered by the cryptographic encipherment unit 11, which makes use of the current crypto key setting contained in the crypto key 12, to produce the cryptographically enciphered message $C(I_S + P + T_1)$ which is then transmitted by the ship's transmitter 10. For convenience, this message is represented as $M_{US}$. In other words:

$$M_{US} = C(I_S + P + T_1)$$

Reports by aircraft are produced in exactly the same way, with $I_A$, the code word assigned to the aircraft, replacing $I_S$. Blocks 13–18 perform the same functions respectively for an aircraft that blocks 47–49 and 10–12 perform for a ship.

The enciphered message $M_{US}$ is received by the fixed-position (geostationary) satellite's receiver 19. Each time reception of such a message is completed by the receiver 19, a trigger is sent to the satellite's clock 20 causing it to send the time-of-day $T_2$ (a 17-bit binary message) to the transmitter 21. The enciphered message $M_{US}$ is also sent to the transmitter 21. The transmitter 21 appends the binary message $T_2$ to $M_{US}$ to produce the 63-bit binary message $M_{DF}$. In other words:

$$M_{DF} = M_{US} + T_2$$

$$M_{DF} = C(I_S + P + T_1) + T_2$$

The transmitter 21 then transmits the message $M_{DF}$ to the ground or surface-based identification terminal's receiver 34.

The enciphered message $M_{US}$ may also be received by the variable-position satellite's receiver 22. The receiver 22, upon receipt of a message $M_{US}$ sends a trigger to the clock 23 which then sends the time-of-day $T_2$ to the message formulator 24. The receiver 22 also sends the enciphered message $M_{US}$ to the message formulator 24. The message formulator 24 sends the combined message of $C(I_S + P + T_1) + T_2$ to the storage unit 25 where it is held for a length of time Δ until the variable-position satellite comes within range of a ground or surface-based identification terminal. The message $C(I_S + P + T_1) + T_2$ is then transmitted by the transmitter 26. This delay message is represented as $M_{DV} = \Delta\,[C(I_S + P + T_1) + T_2]$.

If $M_{UA}$ is received by either satellite instead of $M_{US}$ the same operations are performed to produce $$M_{DF} = C(I_A + P + T_1) + T_2$$

and $$M_{DV} = \Delta\,[C(I_A + P + T_1) + T_2]$$

respectively.

The message $M_{DF}$ or $M_{DV}$ is received by the ground or surface-based identification terminal's receiver 34 which sends it to the cryptographic decipherment unit 35. The decipherment unit uses key-setting information from the crypto key 36 (the same as 12 and 18) to decipher the enciphered portion of $M_{DF}$ or $M_{DV}$ and thus produce the message $I_S + P + T_1 + T_2$ (or $I_A + P + T_1 + T_2$ for aircraft). This message is then sent to the validator 37 which compares $T_1$ and $T_2$ to see if $$|T_2 - T_1| \leqq T_{ms}$$

where $T_{ms}$ = The maximum time difference permissible for transmissions from ships. (3 seconds for the ± 1 second accuracy assumed here for $T_1$ and $T_2$), or to see if $$|T_2 - T_1| \leqq T_{ms} \text{ (or } T_{ma} \text{ for aircraft)}$$

then the message $I_S + P + T_1$, indicating the position P of the ship whose identity code word is $I_S$ at the time $T_1$ is sent to the display unit 38 where it may be correlated with targets displayed by the data processor 39 for other sensors.

Ships and aircraft may also be identified by this system without using satellites if the identification terminal is within direct r-f range of the vehicle to be identified. In this case the messages $M_{US}$ or $M_{UA}$ are prepared and transmitted in exactly the same manner as previously described, but these messages are sent directly to the ground or surface-based identification terminal's receiver 27. The receiver 27, upon receipt of a message $M_{US}$ (or $M_{UA}$) sends a trigger to the clock 28 which then sends the time-of-day $T_2$ directly to the validator 31. The receiver 27 also sends the enciphered message $M_{US}$ (or $M_{UA}$) to the cryptographic decipherment unit 29 which uses key setting information from the crypto key 30 (exactly the same as 12 and 18) to decipher the message. It then sends the deciphered message $I_S + P + T_1$ (or $I_A + P + T_1$) to the validator 31 which compares $T_1$ and $T_2$ in exactly the same manner as described for the validator 37. If $|T_2 - T_1| \leqq T_{ms}$ (or $T_{ma}$) then the valid message $I_S + P + T_1$ (or $I_A + P + T_1$) is sent to the display unit 32 where it is correlated with targets produced by other sensors 33 e.g. radar.

The manner in which the binary messages are actually transmitted and received is neglected in the above description, because the invention is independent of how transmission and reception are made except that the transfer of binary information must be done reliably. Also, no details are provided concerning the actual cryptographic system to be used, since any cryptosecure system that makes use of common key-setting information in both encipherment and decipherment units and has adequate capacity may be used. To those skilled in the art, the cryptographic encipherment and decipherment of 46 bit binary messages is not a problem.

The Secure Position Identity and Time Reporting system described here need not use the ± 1 sec time synchronization suggested here. For many applications, much less precise time accuracy may be adequate. The r-f transmissions required may be made via spread-spectrum techniques and directive antennas may be used. In fact, all of the new developments in communications technology may be applied to this system since it uses conventional (crypto-secure) communications links for its reports.

Thus a description in detail of how a single SPIT report may be made by a ship or an aircraft via an instantaneous-relay station (such as a geostationary satellite or a relay aircraft), or via a low-altitude satellite to a central processor and how the same report may be made via direct r-f transmission to a direct mode data analyzer has been described. Reports of the type described may be scheduled to meet the needs of satellites, of surveillance terminals, or of tactical military forces. It should be noted that the interval of time between reports is independent of the time between changes in the clock readings $T_1$ (or $T_2$). In other words, aircraft, whose position changes considerably in one second's time, may make many secure reports of their position and identity during a single 1-second interval, while ships, which move very little during a second, may make secure reports of their position identity and time only a few times per hour, or even less often in many situations. If a satellite or relay aircraft receives a large number of SPIT reports per second, then some of the reports are likely to be garbled by mutual interference due to the simultaneous arrival of two or more messages at a relay terminal. Very simple scheduling of reports from ships, with sufficient redundancy of reports to permit the occasional loss of a report without deleterious effect, whould reduce the likelihood of serious interference among reports from ships to a negligible figure. Mutual interference among SPIT reports from aircraft could also be reduced by proper scheduling and coding of reports, but additional automatic data-processing equipment would be required both in the reporting aircraft and at the data-processing terminals. Some of the mutual-interference-reduction techniques proposed for current Interrogation Friend or Foe Systems appear to be applicable to an airborne SPIT reporting system where reports are made at relatively high repetition rates. A considerable amount of further study of this mutual interference problem must be made, however, before any firm conclusions concerning use of the SPIT reporting system be large numbers of aircraft can be made.

The problem of keeping track of rapidly-moving aircraft, can be handled by high-speed data-processing equipment with its electronic logic circuitry. It would not be at all difficult to keep track of ships and to correlate their positions with data concerning target locations obtained from other sensors with today's data-processing circuitry. And there are a number of displays that would be suitable for use at a central processing unit.

The SPIT Reporting system appears to offer a simpler and less expensive way of identifying and keeping track of all friendly ships than any of the more-conventional interrogation-reply type identification systems. This is based on the assumption that cryptosecure communications links will have to be available anyway, and that they will have the required small amount of information capacity available for the SPIT reports. If the needed communications channels are available, then the SPIT Reporting system could be used in any, or all, of the three modes (direct, instantaneous relay, or delayed relay) to identify and/or keep track of friendly ships. The SPIT Reporting system may also be used to identify aircraft, but its use to actually track aircraft might impose an intolerable data-processing load on the central processor. An airborne relay station may be substituted for the satellite as an alternative The foregoing description of one embodiment of the present invention has been specific and will suggest many other embodiments to those skilled in the art. For this reason, it is intended that the scope of the present invention be not limited to the foregoing description thereof, but only to the appended claims.

What is claimed and desired to be secured by Letters Patent of the United States is:

1. A cryptosecure identification system comprising:
   - a ship;
   - means aboard said ship for transmitting an enciphered identification code, position, and time of day signal;
   - an airborne relay station;
   - receiver means aboard said relay station;
   - clock means aboard said relay station for supplying the time of day of said received enciphered signal;
   - means aboard said relay station for retransmitting said enciphered signal and said satellite time of day signal;
   - ground receiving means including means for deciphering said retransmitted enciphered signal and comparing the two time of day signals; and
   - means for indicating said signal to be valid if the difference between said two time of day signals is less than a predetermined time.

2. An identification system as recited in claim 1 wherein said relay station is a geostationary satellite.

3. An identification system as recited in claim 1 wherein said relay station is a variable positioned satellite, and further including delay means aboard said satellite for storing said enciphered signal and the satellite time of day until said satellite retransmits to said ground receiving means.

4. An identification system as recited in claim 3 further including: means for displaying and correlating said valid deciphered signal.

5. An identification system as recited in claim 4 wherein said ship is an airship and said time of day signals are produced by clocks.

* * * * *